US011926465B2

(12) United States Patent
Ausch

(10) Patent No.: US 11,926,465 B2
(45) Date of Patent: Mar. 12, 2024

(54) PROCESS AND APPARATUS FOR CARRIER SHIPPING AND LONGER STORAGE OF HELIUM PARTY BALLOONS

(71) Applicant: Party Lovers Inc., Brooklyn, NY (US)

(72) Inventor: Simon Ausch, Brooklyn, NY (US)

(73) Assignee: PARTY LOVERS INC., Brooklyn, NY (US)

( * ) Notice: Subject to any disclaimer, the term of this patent is extended or adjusted under 35 U.S.C. 154(b) by 0 days.

(21) Appl. No.: 17/735,978

(22) Filed: May 3, 2022

(65) Prior Publication Data

US 2023/0356915 A1 Nov. 9, 2023

(51) Int. Cl.

| | |
|---|---|
| ***B65D 81/38*** | (2006.01) |
| ***B65D 81/20*** | (2006.01) |
| ***B65D 85/30*** | (2006.01) |
| *B65B 5/00* | (2006.01) |
| *B65B 7/00* | (2006.01) |
| *B65B 11/00* | (2006.01) |
| *B65B 31/04* | (2006.01) |

(52) U.S. Cl.

CPC ..... *B65D 81/3825* (2013.01); *B65D 81/2061* (2013.01); *B65D 85/30* (2013.01); *B65B 5/00* (2013.01); *B65B 7/00* (2013.01); *B65B 11/00* (2013.01); *B65B 31/04* (2013.01)

(58) Field of Classification Search

None

See application file for complete search history.

(56) References Cited

U.S. PATENT DOCUMENTS

| | | | | | |
|---|---|---|---|---|---|
| 2,869,770 | A | * | 1/1959 | Bass | B65D 5/4616 229/117.14 |
| 2,974,782 | A | * | 3/1961 | Walters | B65D 77/26 206/778 |
| 4,077,588 | A | | 3/1978 | Hurst | |
| 4,290,763 | A | | 9/1981 | Hurst | |
| 4,416,433 | A | * | 11/1983 | Bellina | F21V 3/023 244/33 |
| 4,778,431 | A | | 10/1988 | Dudley | |
| 4,903,958 | A | * | 2/1990 | DiCarlo | B42D 15/045 116/210 |
| 4,917,646 | A | | 4/1990 | Kieves | |
| 5,108,337 | A | * | 4/1992 | Sloan | A63H 27/10 446/224 |

(Continued)

FOREIGN PATENT DOCUMENTS

| | | | | | |
|---|---|---|---|---|---|
| GB | 2236737 | A | * | 4/1991 | A24F 15/18 |
| KR | 102155655 | B1 | * | 9/2020 | B65D 81/03 |

*Primary Examiner* — Tanzim Imam

(74) *Attorney, Agent, or Firm* — OSTROLENK FABER LLP

(57) ABSTRACT

A method that protects helium balloons, which are shipped via shipping routes that expose the balloons to elevated temperatures that cause the balloons to lose helium gas at increased rates, from such effects includes providing a shipping box; lining the shipping box with a metalized sheet that provides insulation against heat conduction; placing at least one balloon in the lined shipping box; surrounding the at least one balloon with the metalized sheet from all sides thereof; closing the box; and shipping the box to a customer, whereby the balloons are rendered less susceptible to the elevated temperatures or reduced ambient pressures while travelling over the shipping routes.

3 Claims, 4 Drawing Sheets

(56) References Cited

U.S. PATENT DOCUMENTS

| | | | | |
|---|---|---|---|---|
| 5,108,339 | A | 4/1992 | Kieves | |
| 5,234,726 | A * | 8/1993 | Dahan | B42D 15/045 229/923 |
| 5,244,429 | A | 9/1993 | Sinclair | |
| 5,338,243 | A | 8/1994 | Kieves | |
| 5,487,706 | A * | 1/1996 | Wilk | A63H 37/00 472/137 |
| 5,492,500 | A | 2/1996 | Sinclair et al. | |
| 6,158,588 | A * | 12/2000 | Conti | B65D 5/4291 116/307 |
| 6,302,171 | B1 * | 10/2001 | Watts | F16K 13/04 116/DIG. 9 |
| 2002/0094396 | A1 | 7/2002 | Ward et al. | |
| 2011/0123684 | A1 * | 5/2011 | Sendel | B65D 77/0433 426/113 |
| 2017/0043271 | A1 * | 2/2017 | Halliburton | A63H 27/10 |
| 2018/0243662 | A1 * | 8/2018 | Bushell | B65D 5/5014 |

* cited by examiner

PROCESS AND APPARATUS FOR CARRIER SHIPPING AND LONGER STORAGE OF HELIUM PARTY BALLOONS

BACKGROUND OF THE INVENTION

The present invention is generally directed to helium-filled, party balloons and, more particularly, to a method and system that guards against balloon deflation during shipping of filled balloons via land and airborne shipping routes.

A toy balloon or party balloon is a small balloon mostly used for decoration, advertising and children's toys. Toy balloons are usually made of rubber or aluminized plastic, and inflated with air or helium. They come in a great variety of sizes and shapes, but are most commonly 10 to 30 centimeters in diameter.

Party and play balloons in various shapes and sizes are sold for use at many social gatherings (e.g. children's and holiday, and special occasion parties) and are used in larger quantities at many promotional or sporting events. Traditionally, balloons are inflated either by blowing into them by mouth or by filling them with helium gas from a large cylinder. The neck of the balloon is then knotted to prevent gas escaping. The knotting operation requires dexterity and becomes all the more tiresome when large quantities of balloons need to be inflated and sealed at, for example, promotional events.

It is now common to seal Mylar balloons by heat. The balloon's neck is subjected to hot pressing which locally melts the neck and forms a seal. This requires expensive machinery and is unsuitable for use with the normal elastomeric toy balloons, since these melt destructively under this treatment.

In general, it has become common place to sell pre-filled balloons and to ship them nationwide using common carriers such as the U.S. Postal Service, UPS, Fed Express and like, which use fleets of trains, trucks and delivery jet planes to quickly ship the helium filled balloons to their customers.

Early balloons were made from pig bladders and animal intestines. The first rubber balloons were made by Michael Faraday in 1824 for use in his experiments with hydrogen at the Royal Institution in London. Latex rubber toy balloons were introduced by pioneer rubber manufacturer Thomas Hancock the following year in the form of a do-it-yourself kit consisting of a bottle of rubber solution and a condensing syringe. Vulcanized toy balloons, which unlike the earlier kind were unaffected by changes in temperature, were first manufactured by J. G. Ingram of London in 1847 and can be regarded as the prototype of modern toy balloons.

In the 1920s Neil Tillotson designed and produced a latex balloon with a cat's face and ears from a cardboard form which he cut by hand with a pair of scissors. He managed to make his first sale of these balloons with an order of 15 gross to be delivered for the annual Patriots' Day Parade on Apr. 19, 1931. The first colored balloons were sold at the 1933-34 Chicago World's Fair. Twister balloons, popular with balloon sculptors, appeared on the scene in the 1950s, and foil Mylar balloons were introduced in the 1970s.

Non-latex balloons, often referred to as metalized balloons, have been popular for many years. See, e.g., U.S. Pat. Nos. 4,077,588; 4,290,763 and 4,917,646, the teachings of which are incorporated herein by reference. Typically one or more sheets of the non-latex balloon is printed with a colorful decoration, such as a character, design, message, or combination thereof. More recently, toy products have developed which include a combination of balloons or a combination of balloons and other structures, such as appendages. See, e.g., U.S. Pat. Nos. 5,338,243; 4,778,431 and 5,108,339, the teachings of which are also incorporated herein.

Films constructed of multiple layers are known in the art as a viable strategy to combine the characteristics of each film layer into an overall film construction. For example, it is well known in the art that metalizing polymeric films improves the barrier properties of that film towards water and gases such as carbon dioxide, oxygen and also lighter-than-air gas, such as helium. In the case of the latter, metalized polymeric films have found wide application for producing helium filled balloons. For example, metalized polyamides (e.g., Nylon 6) have been widely used in this application. However, the difference in mechanical properties between the Nylon layer and metalized layer can be problematic. Upon inflation of a balloon, the Nylon layer stretches and can cause microscopic cracks in the metalized layer because the metalized layer does not have the same elastic properties as the Nylon. This unfortunately reduces the barrier properties of the film and subsequently the inflated life of the balloon. One strategy to alleviate this problem is to utilize a higher modulus, more stretch resistant polymeric film. Polyethylene terephthalate (PET) is an example. However, when a more stretch resistant film is utilized in a helium balloon construction this often results in greater instances in seam failure and film cracking because the force that was being dissipated by the film is now more highly concentrated at other areas of the balloon.

Non-latex balloon products are known in the art that use an elastomeric sealant layer that comprises linear low density polyethylene (LLDPE) that can be inflated to greater than one atmosphere of pressure with air or lighter than air gas. The elastomeric sealant layer has a thickness in the range from about 5 to about 50 microns and has a seal strength to itself that is greater than 2000 g/in. The balloon has a core polyester layer that comprises polyethylene terephthalate (PET).

Helium gas is made of the smallest "molecules," susceptible to leakage even out of metalized balloons. Helium is a noble gas and therefore its "molecules" are single atoms. Of the noble gases, helium has the smallest atom. Although hydrogen atoms are smaller than helium atoms, a molecule of hydrogen is made of two atoms that are connected by a bond. As a result, a hydrogen molecule is hugely bigger than a helium "molecule." Hydrogen does not leak through materials anywhere near as fast as helium does. Hence, these molecules can work their way between the molecules of the balloon skin (rubber) and leak out quite easily.

Helium is a colorless, odorless, tasteless and nontoxic inert gas that is often used to inflate party balloons because it is lighter than air. According to the law of buoyancy, as long as the weight of the helium and the balloon are lighter than the weight of the air, the balloon will float. Helium, which makes up approximately 0.0005 percent of the air we breathe, is the second lightest element. It weighs 0.1785 grams per liter.

BoPET (biaxially-oriented polyethylene terephthalate) is a polyester film made from stretched polyethylene terephthalate (PET) and is used for its high tensile strength, chemical and dimensional stability, transparency, reflectivity, gas and aroma barrier properties, and electrical insulation. A variety of companies manufacture boPET and other polyester films under different brand names. In the UK and US, the best-known trade names are Mylar, Melinex, and Hostaphan.

The manufacturing process begins with a film of molten polyethylene terephthalate (PET) being extruded onto a chill roll, which quenches it into the amorphous state. It is then biaxially oriented by drawing. The most common way of doing this is the sequential process, in which the film is first drawn in the machine direction using heated rollers and subsequently drawn in the transverse direction, i.e. orthogonally to the direction of travel, in a heated oven. It is also possible to draw the film in both directions simultaneously, although the equipment required for this is somewhat more elaborate. Draw ratios are typically around 3 to 4 in each direction.

Once the drawing is completed, the film is "heat set" or crystallized under tension in the oven at temperatures typically above 200° C. (392° F.). The heat setting step prevents the film from shrinking back to its original unstretched shape and locks in the molecular orientation in the film plane. The orientation of the polymer chains is responsible for the high strength and stiffness of biaxially oriented PET film, which has a typical Young's modulus of about 4 GPa ($0.58\times10^6$ psi). Another important consequence of the molecular orientation is that it induces the formation of many crystal nuclei. The crystallites that grow rapidly reach the boundary of the neighboring crystallite and remain smaller than the wavelength of visible light. As a result, biaxially oriented PET film has excellent clarity, despite its semicrystalline structure.

If it were produced without any additives, the surface of the film would be so smooth that layers would adhere strongly to one another when the film is wound up, similar to the sticking of clean glass plates when stacked. To make handling possible, microscopic inert inorganic particles are usually embedded in the PET to roughen the surface of the film such as silicon dioxide. Biaxially oriented PET film can be metallized by vapor deposition of a thin film of evaporated aluminum, gold, or other metal onto it. The result is much less permeable to gases (important in food packaging) and reflects up to 99% of light, including much of the infrared spectrum. For some applications like food packaging, the aluminized boPET film can be laminated with a layer of polyethylene, which provides sealability and improves puncture resistance. The polyethylene side of such a laminate appears dull and the boPET side shiny. Other coatings, such as conductive indium tin oxide (ITO), can be applied to boPET film by sputter deposition. Metallized boPET film in NASA's spacesuits make them radiation resistant and help regulate temperature. Longer life, metalized, helium balloons have been described in U.S. Patent Publication No. 2002/0094396, the contents of which are incorporated by reference herein. But these balloons, which materially increase the shelf life of such balloons, require more elaborate and expensive production costs.

Also, helium is sensitive to temperature changes. Cold air causes the helium to shrink, which makes the balloon appear to deflate, although it still floats. Heat can cause the helium to expand and the balloon to burst. Therefore, the best place to store a helium balloon is a cool, dark room absent of wind and dust.

The present inventor has observed that some helium balloons shipped to customers via land and air carriers arrive at the customers sites deflated and visibly unattractive, which is actually unexpected as air carriers are able to ship them within 24 to 48 hours, which ordinarily is well short of the shelf life of balloons of this type. The observed problem of quickly deflating balloons manifests itself only sometimes and an objective of the present invention is to solve this drawback of the prior art.

To the present inventor's knowledge, the prior art has not addressed the problems and special requirements that attends attend the process of shipping filled helium balloons via land and air shipping routes. Prior art patents discuss extending the buoyant life of balloons. See for example U.S. Pat. Nos. 5,244,429 and 5,492,500 to Sinclair, the contents of which are incorporated by reference herein. But these patents discuss an elaborate process involving coating the inside or outside surfaces of inflated balloons with a special sealing layer, which is wholly irrelevant and impractical to use to solve the above problems that occur just during shipping of these balloons.

SUMMARY OF THE INVENTION

Accordingly, it is an object of the present invention to provide a method and apparatus that alleviates or at least ameliorates the problem of helium balloons shipped through common land and air carriers becoming deflated.

In accordance with a preferred embodiment of the present invention helium filled balloons are shipped to their destinations by being packed into boxes that are lined with metallic foil sheet, preferably mylar or even aluminum foil, that both insulates the balloons against rapid changes in their interior temperatures. The lining can be loosely placed inside the box or adhered to its interior walls.

In accordance with other embodiments of the present invention, helium filled balloons are temporarily encased while being shipped in outer containers that protect them against leakage of the helium gas under conditions of large temperature variations and ambient pressure conditions during shipment.

In preferred embodiments, the invention is directed to methods comprising: providing at least one shipping box; lining the shipping box with a metalized sheet that provides insulation against heat conduction; placing at least one balloon in the lined shipping box; surrounding the at least one balloon with the metalized sheet from all sides thereof; closing the box; and shipping the box to a customer, whereby the at least one balloon is rendered less susceptible to the elevated temperatures while travelling on the shipping routes. The metalized sheet comprises heat-insulative foil material, e.g., Mylar or aluminum foil.

In another embodiment, the method comprises: providing a shipping box; providing an outer bag and inserting a balloon that is filled with helium gas at a given pressure into the outer bag; filling an intermediate space between the outer bag and the at least one balloon with air at a pressure higher than said given pressure, with the intermediate space being sealed off from the atmosphere outside the bag; placing the outer bag with the balloon therein into the shipping box; closing the shipping box; and shipping the box to a customer, whereby the helium balloon is shielded from leaking gas or exploding due to being exposed to the elevated temperatures or reduced ambient pressures while travelling over the shipping routes. This method further may include preparing a plurality of said balloon, each individually inserted into its respective outer bag and each bag inflated with air to pressure higher than said given pressure; and inserting and shipping said plurality of balloons in said shipping box to an intended recipient thereof. The outer bag is provided with an inflating port for injecting said air into said intermediate space. Alternatively, the bag has a zippered opening that can be opened to insert the balloon into the outer bag, with a sealing lip inside the outer bag that seals the zippered opening when the intermediate space is pressurized.

In another embodiment, the method comprises: providing a shipping box; tightly wrapping a balloon that is filled with helium gas at a given pressure with a thin surface-clinging material sheet that prevents walls that define the shape of the balloon from expanding and thereby either leaking or bursting when the balloon is exposed to said elevated temperatures or reduced ambient pressure during its transit over said shipping routes; placing the wrapped balloon into the shipping box; closing the shipping box; and shipping the box to a customer, whereby the helium balloon is shielded from leaking gas or bursting due to being exposed to the elevated temperatures or reduced ambient pressures while travelling over the shipping routes. The surface-clinging material sheet is made of polyvinylidene chloride (PVDC) or polyethylene or of a netted material that strengthens the walls of the balloons and prevents them and their seam lines from leaking or bursting during transit.

Other features and advantages of the present invention will become apparent from the following description of the invention which refers to the accompanying drawings.

DETAILED DESCRIPTION OF PREFERRED EMBODIMENTS OF THE INVENTION

Figure 1:
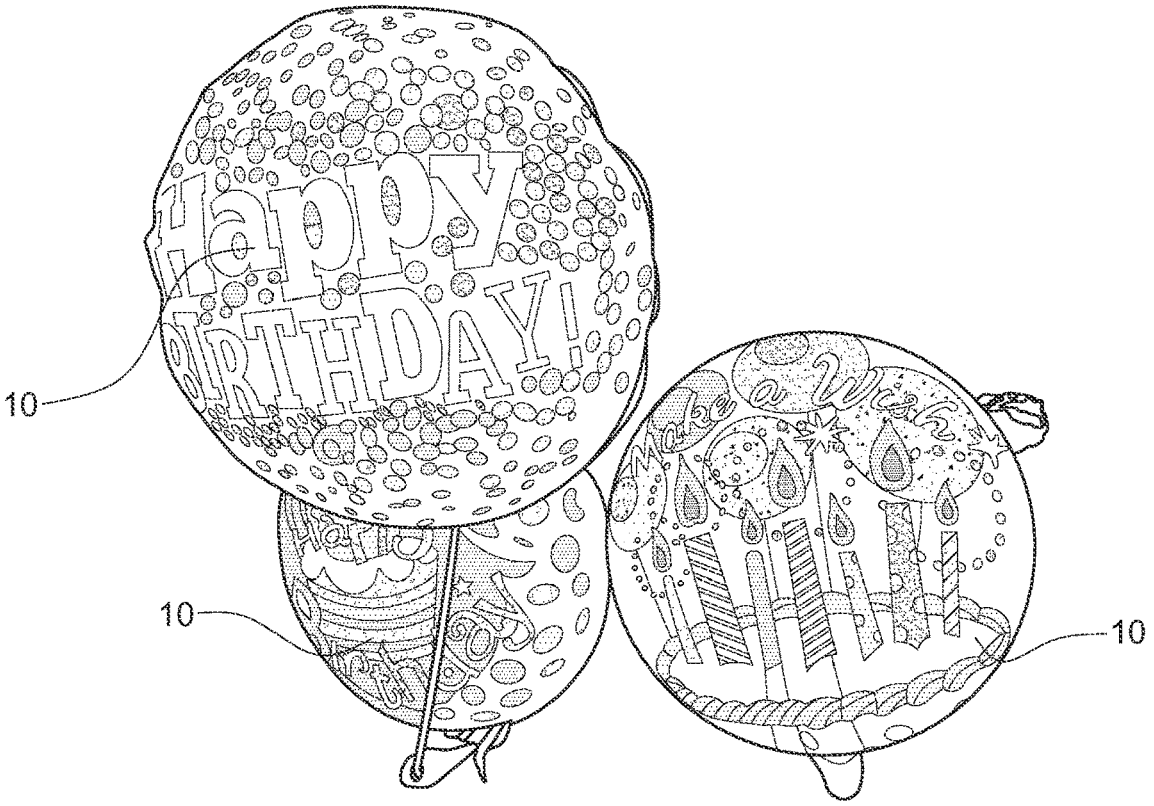
FIG. 1 (PRIOR ART)
FIG. 1 depicts prior art helium filled balloons.

According the present invention, the inexplicable occasional loss of helium in prior art balloons that are shipped via land and air carriers is solved by one or the other of the several expedients described below. The expedients described below perceive that the deflation problem that has been observed when shipping via land and air carrier is somehow associated with the fact that shippers store the goods being shipped in either warehouses or very large shipping containers that experience steep temperature increases. Foil balloons are typically constructed of two or more foil sections that are attached to each other at connection seams that use heating methods to fuse the sections to each other. Further, metalized foil is a material that does not and is not intended to be subjected to stretching forces. Yet, the temporarily elevated temperatures to which the balloons are subjected during shipping stress the foil gas containers owing to the high sensitivity of the helium gas to temperature gradients pursuant to the ideal gas formula: $pV=nKT$, where p=pressure; V=volume; nK relate to the Boltzman constant and T=temperature. In foil balloons, the V parameter is invariable. Hence, any temperature elevation translates immediately into a corresponding rise in pressure, which causes the more vigorously colliding and extremely small sized helium molecules to escape from the foil container, through sub-micron cracks in the seam lines and similarly sized pores in the foil surfaces.

Hence, upon arrival, the balloons will have suffered a helium gas loss during transit, causing the balloon walls to unseemly sag and lose their buoyancy despite the normal temperatures and ambient atmospheric conditions.

In similar manner, even without being subjected to elevated temperatures, air shipped balloons might be subjected to reduced pressure conditions in non-pressurized or under-pressurized cargo airliner compartments. Here too, the pressure gradient between the outer environment and the interiors of the balloons causes the helium molecules to energetically strive to leave the confines of the balloons which over time results in helium gas leakage and the same undesirable balloon effects.

In accordance with a preferred embodiment of the invention, shipping of the subject helium filled balloons to customers comprises lining the shipping box with a metalized foil sheet, placing a number of these balloons therein and then covering the entire balloon assemblage with the metalized foil sheet. Thereafter, the box is closed and forwarded to the shipping company to be delivered to the various customers.

To the present inventor's understanding, the foil style sheet has the property, similar the widely used kitchen style aluminum foil, that it is a poor heat conductor, i.e., a good heat insulator. Therefore, during temporary elevated heat conditions encountered during shipping, the metal foil in which the balloons are wrapped acts as heat transfer barrier that stops or greatly slows heating of the helium gas. The deleterious gas loss effects described above are thereby avoided or at the least so reduced as to be adequate for shipping inflated balloons to customers.

Figure 2:
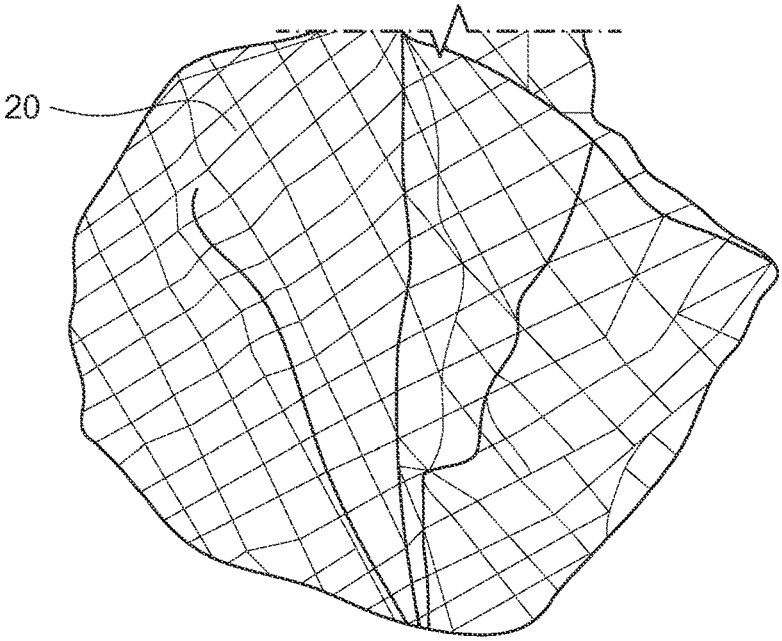
FIG. 2 (PRIOR ART)
FIG. 2 depicts a prior art metalized foil sheet
Figure 3:
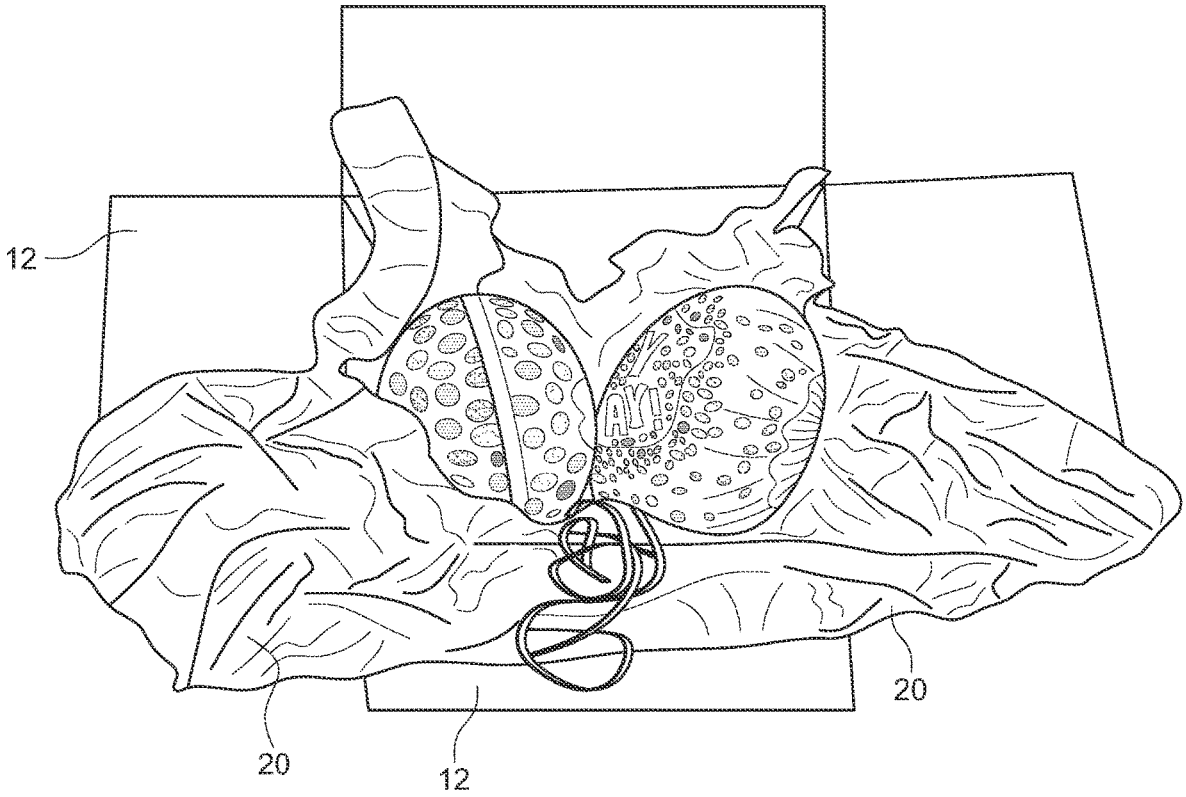
FIG. 3 depicts an ordinary packaging box lined with the metalized foil sheet, surrounding a number of helium filled balloons.

As simply depicted in FIGS. 1 through 3, the inflated helium balloons 10 are prepared for being shipped by being placed inside and ordinary box 12 that has been pre-lined with foil sheet 20 that has selvages 22 sufficient to tightly wrap the balloons from all sides. Thereafter, the box 12 is closed with tape and the like, shipping address labeled and entrusted to the shipping carrier for the delivery to the intended customer. Of course, the foil sheet 20 may be loosely placed against the interior walls of the box 12.

Figure 4:
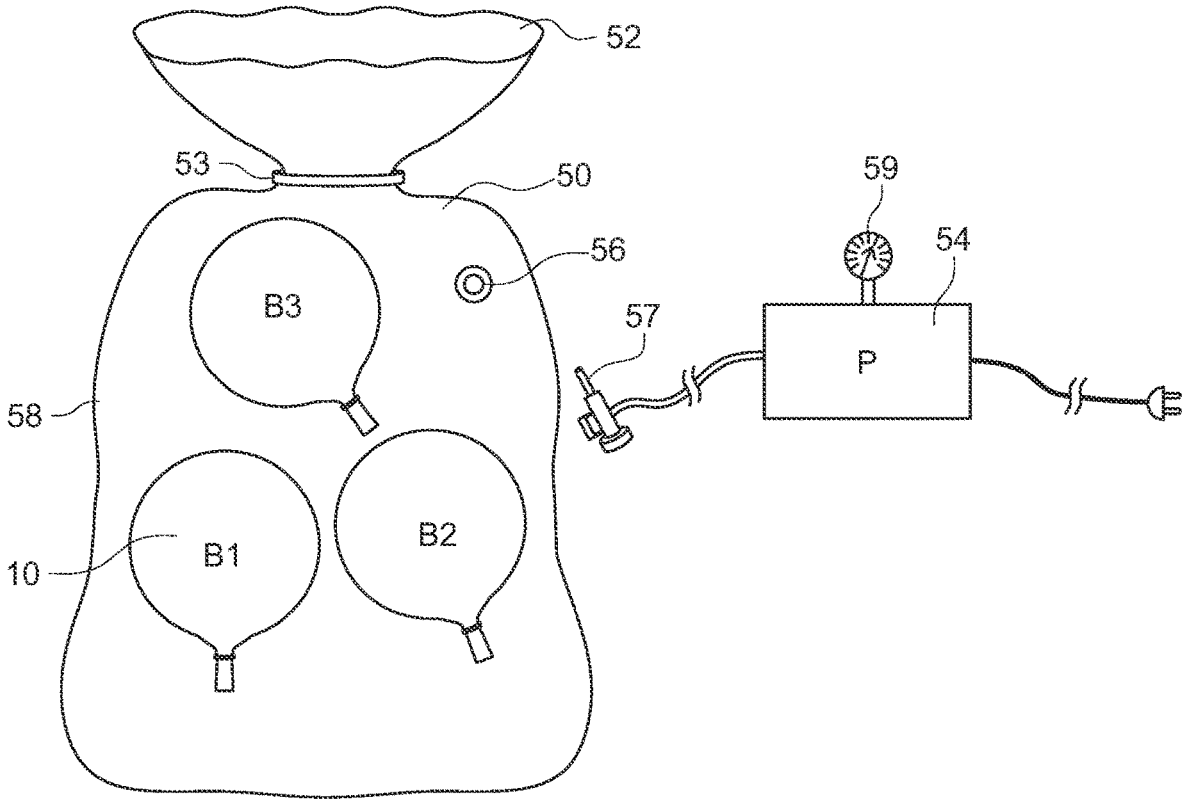
FIG. 4 depicts a first alternate embodiment in which a number of balloons are stored in a pressurized outer bag for shipment.

In accordance with a more elaborate variant of the invention, the balloons are protected from losing their internal helium gas by being shipped enclosed in an outer flexible walled container 50 that is internally pressurized, just slightly above the pressure inside the balloons 10. As shown in FIG. 4, the outer container or bag 50 has a large mouth 52 through with the balloons are inserted. The internal volume of the outer bag 50 is slightly smaller than that of the shipping outer box 12. With the balloons 10 within, the mouth 52 is hermetically closed off, e.g., by heat sealing, a clamp 53 or the like. Thereafter, an ordinary air pump 54, e.g., a small portable pump running on 12 volts, is used to inflate the interior of the container 50 with air, via a one-way inflating port or nipple 56 (into which a needle 57 of the pump 54 is inserted). For example, if the pressure inside the balloons is say about 15-16 PSI (pounds per square inch), then the interior container air is set to be about 16-17 PSI (observable at the gauge 59), it being noted that atmospheric pressure at sea level is 1 ATM (which is about 14.6 PSI).

The wall 58 of the container 50 can be make of stretchable latex, or plastic or any flexible material, or even non-stretching material, it being noted that unlike the balloons which need to buoyant and therefore have very thin walls, the wall 58 can be heavier gauged to assure that the pressurized air within will not leak out, even when its temperature has been materially elevated (as during shipping). Of importance here is that the air in the container 50 surrounds the balloons from all sides and causes the helium gas to assume that pressure, the balloon walls and seam points or lines will not leak owing to the pressure on both sides being approximately equal at all temperatures, even elevated temperatures. Similarly, below atmospheric pressures that may prevail inside an air plane's cargo bins will have no effect on the balloons that our surrounded by their own atmosphere established inside the outer container 50. The net result is that balloons will arrive at their ultimate destinations without any loss of internal helium gas, allowing them to be enjoyed for longer periods. All one need do is open the shipping box 12, pierce the container 50 to release its pressure and then cut it to remove the balloons 10.

Figure 5:
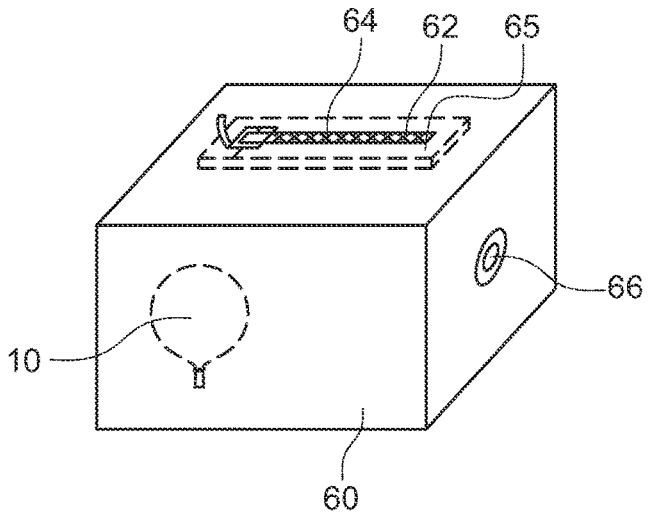
FIG. 5 depicts a variation on the embodiment of FIG. 4, showing a square/rectangular outer box with a zippered opening.

In the embodiment of FIG. 5, the modified outer container 60 has a shape that is substantially square or rectangular and conformed to that of the shipping box 12, and also includes a zippered opening 62 that is opened to insert the balloons 10. Inside, just under and covering the zipper 64 a dangling sealing flap 65 that adheres underneath the zipper 64 and seals it against leakage when the inside pressure is increased as described above. This sealing container is similarly inflated via its inflation nipple 66 as previously described.

In accordance with another variant of the invention, the balloons 12 are tightly wrapped in clingy sheets of polyvinylidene chloride (PVDC), also known as Saran Wrap, to prevent the balloons 12 walls from expanding when exposed to elevated temperatures during shipping, thereby encasing the balloons individually. This should help reduce stress on the balloon seams and prevents any stretching and increasing the pore sizes in these walls. Again, helium gas loss which is the culprit during shipping is arrested. Nowadays, sheets with properties similar to Saran Wrap can be made from polyethylene.

The present invention also contemplates using the above described expedients to increases the storage life of balloons. That is, rather than waiting for order for specific balloons to arrive and then inflating the balloons only shortly before shipping, a large number of balloons filled with helium can be inventoried without fear of loss of gas by storing them in the pressurized air containers described above while awaiting to be ordered. Thereby, large balloon supplier can inflated balloons long prior to any orders and thus avoid the challenge and expenses that might arise when quickly needing to inflate many hundreds of balloon on a very short notice. These in-store containers can be very large sized holding dozens of balloons and used and reused as needed.

Figure 6:
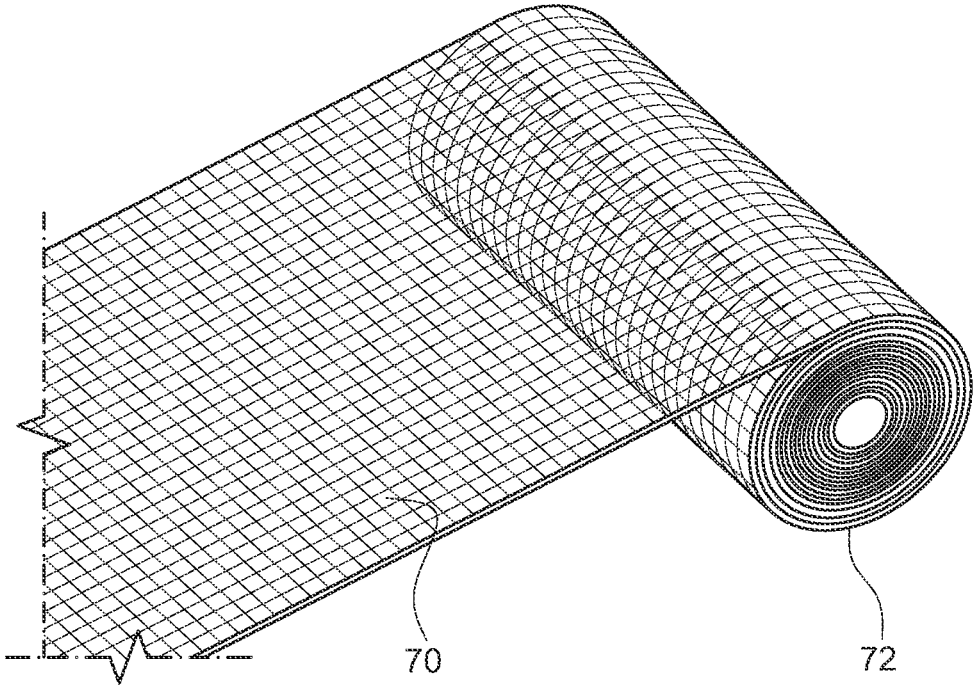
FIG. 6 shows conventional cloth or plastic, non-stretchable netting sheet material for use to tightly wrap filled balloons so they do not leak or burst during shipment.

In accordance with another embodiment of the present invention, as shown in FIG. 6, the inflated balloons are each individually tightly wrapped in non-stretchable netting material 70 cut from a roll 72. This expedient is designed to prevent the heated helium within from stretching and tearing the Mylar walls during shipping, regardless of whether the gas pressure from within is caused by elevated temperatures or reduced ambient pressures encountered during high altitude flying. The material 70 is tightly wrapped ensuring to cover all the seam lines in the balloon and the free edge maybe taped down conventionally.

Although the present invention has been described in relation to particular embodiments thereof, many other variations and modifications and other uses will become apparent to those skilled in the art. It is preferred, therefore, that the present invention be limited not by the specific disclosure herein, but only by the appended claim.

What is claimed is:

1. A method of shipping helium balloons via shipping routes that expose the balloons to elevated temperatures that cause the balloons to lose helium gas at increased rates, the method comprising:

providing at least one shipping box;

lining the at least one shipping box with a metalized sheet that provides insulation against heat conduction;

placing at least one balloon in the at least one lined shipping box;

surrounding the at least one balloon with the metalized sheet from all sides thereof;

closing the at least one shipping box; and shipping the at least one shipping box to a customer, whereby the at least one balloon is rendered less susceptible to the elevated temperatures while travelling on the shipping routes;

wherein the metalized sheet comprises heat-insulative foil material.

2. The helium balloons shipping method of claim 1, wherein the metalized sheet comprises aluminum foil.

3. The helium balloons shipping method of claim 1, wherein the at least one balloon comprises more than two balloons.

* * * * *